US008579208B2

(12) United States Patent
Vandergriff

(10) Patent No.: US 8,579,208 B2
(45) Date of Patent: Nov. 12, 2013

(54) ADJUSTABLE HEIGHT WATER DRINKING FOUNTAIN

(76) Inventor: Gary L. Vandergriff, Midland, TX (US)

( * ) Notice: Subject to any disclaimer, the term of this patent is extended or adjusted under 35 U.S.C. 154(b) by 207 days.

(21) Appl. No.: 13/189,520

(22) Filed: Jul. 24, 2011

(65) Prior Publication Data

US 2013/0020401 A1 Jan. 24, 2013

(51) Int. Cl.
*B05B 12/14* (2006.01)

(52) U.S. Cl.
USPC ..... 239/28; 239/27

(58) Field of Classification Search
USPC ..... 239/24–29, 32
See application file for complete search history.

(56) References Cited

U.S. PATENT DOCUMENTS

| | | | | |
|---|---|---|---|---|
| 599,706 | A | 3/1898 | Heineken | |
| 1,305,624 | A * | 6/1919 | Schneider et al. | 4/644 |
| 1,406,426 | A | 2/1922 | Stewart | |
| 1,446,509 | A | 2/1923 | Koprowicz | |
| 1,855,864 | A | 4/1932 | Mjaaland et al. | |
| 2,817,094 | A | 12/1957 | Lessley | |
| 2,958,871 | A | 11/1960 | Eskenazi et al. | |
| 3,347,591 | A | 10/1967 | Soroos et al. | |
| 3,456,264 | A | 7/1969 | Flagg | |
| 3,486,175 | A | 12/1969 | Schwartz | |
| 4,233,693 | A | 11/1980 | Stockloew | |
| 4,295,233 | A | 10/1981 | Hinkel et al. | |
| 4,295,609 | A | 10/1981 | Brown, Jr. | |
| 4,328,597 | A * | 5/1982 | Bodin | 4/644 |
| 4,998,303 | A | 3/1991 | Smithers | |
| 5,033,508 | A | 7/1991 | Laverty, Jr. | |
| 5,050,253 | A | 9/1991 | Wasek | |
| 5,230,109 | A | 7/1993 | Zaccai et al. | |
| 5,628,075 | A | 5/1997 | Dudnik et al. | |
| 5,647,074 | A | 7/1997 | White, Jr. et al. | |
| 5,867,847 | A | 2/1999 | Klawitter et al. | |
| 5,893,396 | A | 4/1999 | Vagle | |
| 5,896,595 | A | 4/1999 | Spencer | |
| 6,073,276 | A | 6/2000 | Rasmussen | |

(Continued)

FOREIGN PATENT DOCUMENTS

| | | |
|---|---|---|
| DE | 3334481 A1 | 4/1985 |
| EP | 0140824 A2 | 5/1985 |

(Continued)

*Primary Examiner* — Davis Hwu
(74) *Attorney, Agent, or Firm* — Lawrence E. Laubscher, Sr.; Lawrence E. Laubscher, Jr.

(57) ABSTRACT

An adjustable height water drinking fountain includes a generally horizontal water drinking fountain body having front and rear ends, and an upper surface containing a water collecting basin. The fountain body is pivotally connected at its rear end with a vertical support for pivotal movement about a horizontal pivot axis. A normally closed water supply valve is operable to supply water to a faucet adjacent the basin via a supply conduit, and a drain pipe serves to remove water from the basin. Each of the water supply and drain conduits includes at least one flexible portion to permit the pivotal movement of the fountain body, whereby the fountain body can be pivoted upwardly of downwardly from a normal horizontal position for use by a standing person or by a person seated in a wheel chair.

14 Claims, 5 Drawing Sheets

(56) References Cited

U.S. PATENT DOCUMENTS

| | | | | |
|---|---|---|---|---|
| 6,170,096 | B1 | 1/2001 | Rasmussen | |
| 6,477,725 | B1 | 11/2002 | Hong et al. | |
| 6,711,757 | B2 | 3/2004 | Peck | |
| 7,111,337 | B2 | 9/2006 | Hong | |
| 2004/0040086 | A1 | 3/2004 | Eisenberg et al. | |
| 2005/0023370 | A1* | 2/2005 | Hong | 239/24 |
| 2005/0066438 | A1 | 3/2005 | Hong | |
| 2005/0194404 | A1 | 9/2005 | Perdue | |
| 2005/0275322 | A1 | 12/2005 | Mosel et al. | |

FOREIGN PATENT DOCUMENTS

| | | | |
|---|---|---|---|
| GB | 2162421 | A | 7/1985 |
| GB | 2248389 | A | 9/1990 |
| GB | 2267031 | A | 3/1992 |
| JP | 1284626 | A | 11/1989 |
| JP | 2003328406 | A | 11/2003 |

* cited by examiner

ADJUSTABLE HEIGHT WATER DRINKING FOUNTAIN

BACKGROUND OF THE INVENTION

1. Field of the Invention

An adjustable height water drinking fountain includes a generally horizontal water drinking fountain body having front and rear ends, and an upper surface containing a water collecting basin. The fountain body is pivotally connected at its rear end with a vertical support for pivotal movement about a horizontal pivot axis. A normally closed water supply valve is operable to supply water to a faucet adjacent the basin via a supply conduit, and a drain pipe serves to remove water from the basin. Each of the water supply and drain conduits includes at least one flexible portion to permit the pivotal movement of the fountain body, whereby the fountain body can be pivoted upwardly of downwardly from a normal horizontal position for use by a standing person or by a person seated in a wheel chair.

2. Description of Related Art

Adjustable height water fountains and the like are well known in the prior art. In the early (1898) Heineken U.S. Pat. No. 599,706, a holder is disclosed for adjusting a wash basin to various heights. In the Brown U.S. Pat. No. 4,295,609, the water fountain is provided with a push bar actuating device for operation by a user in a wheelchair. Note also the public toilet facility for use by a person in a wheelchair, as set forth in the White et al U.S. Pat. No. 5,647,074. In the Rasmussen U.S. Pat. No. 6,073,276, the wash basin is pivotally connected for angular adjustment relative to a fixed support, and the Peck U.S. Pat. No. 6,711,757 teaches a portable fluid dispensing device having a vertically adjustable sink.

The use of conventional drinking fountains, and the fixed mounting heights thereof, have historically been in response to nationally recognized building code requirements and in particular the Americans with Disability Act (ADA). On Jul. 28, 1991, the Federal Government published the ADA in the federal register Volume 56, No. 144. In particular, Paragraphs 4.1.3 (10), 4.15 and 4.27.4 of the ADA—Accessibility Guidelines (ADA-AG) discuss drinking fountains. The U.S. Department of Justice published the final rule which revises the regulations that implement the Americans with Disabilities Act (ADA) with an enforcement date of Mar. 15, 2012. The new federal accessibility standards will be known as the 2010 Standards for Accessible Design (SAD).

No patented prior art has been noted for either vertically adjusted drinking fountains or vertically adjusted plumbing devices that completely anticipate the invention.

SUMMARY OF THE INVENTION

Accordingly, a primary object of the present invention is to provide an adjustable height water drinking fountain including a generally horizontal water drinking fountain body having front and rear ends, and an upper surface containing a water collecting basin, said fountain body being pivotally connected at its rear end with a vertical support for pivotal movement about a horizontal pivot axis, whereby the fountain body can be pivoted upwardly of downwardly from a normal horizontal position for use by a standing person or by a person seated in a wheel chair.

According to a more specific object of the invention, a normally closed water supply valve is operable to supply water to a faucet adjacent the basin via a supply conduit, and a drain pipe serves to remove water from the basin, each of the water supply and drain conduits including at least one flexible portion, thereby to permit upward and downward pivotal movement of the fountain body.

According to a further object, first stop means are provided for limiting the extent of downward pivotal movement of said fountain body from said normal horizontal position, and second stop means are provided for limiting the extend of upward pivotal movement of said fountain body from said normal horizontal position.

Another object is to provide a vertical front access plate containing an opening that receives the rear end portion of said fountain body, said access plate being adapted for mounting on the vertical support, together with flexible seal means for sealing the space between the upper and side surfaces of said fountain body and the edges of said access plate opening when said fountain body is in said raised position, said seal means at least partially defining said second stop means. The upper surface of the rear end of said fountain body is inclined upwardly in an arcuate concave configuration: and the seal means includes a horizontal portion that is engaged by said arcuate upper surface when said fountain body is in said raised position.

According to another feature, the adjustable height water drinking fountain is pivoted about a pivot axis that is at a higher elevation than that of the front edge of the upper surface of said fountain body; and further wherein said pivot means includes a pair of parallel laterally-spaced pivot arms arranged between and connected with the inner surfaces of the side walls of said fountain body, respectively, said pivot arms being connected for pivotal displacement about said pivot axis.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
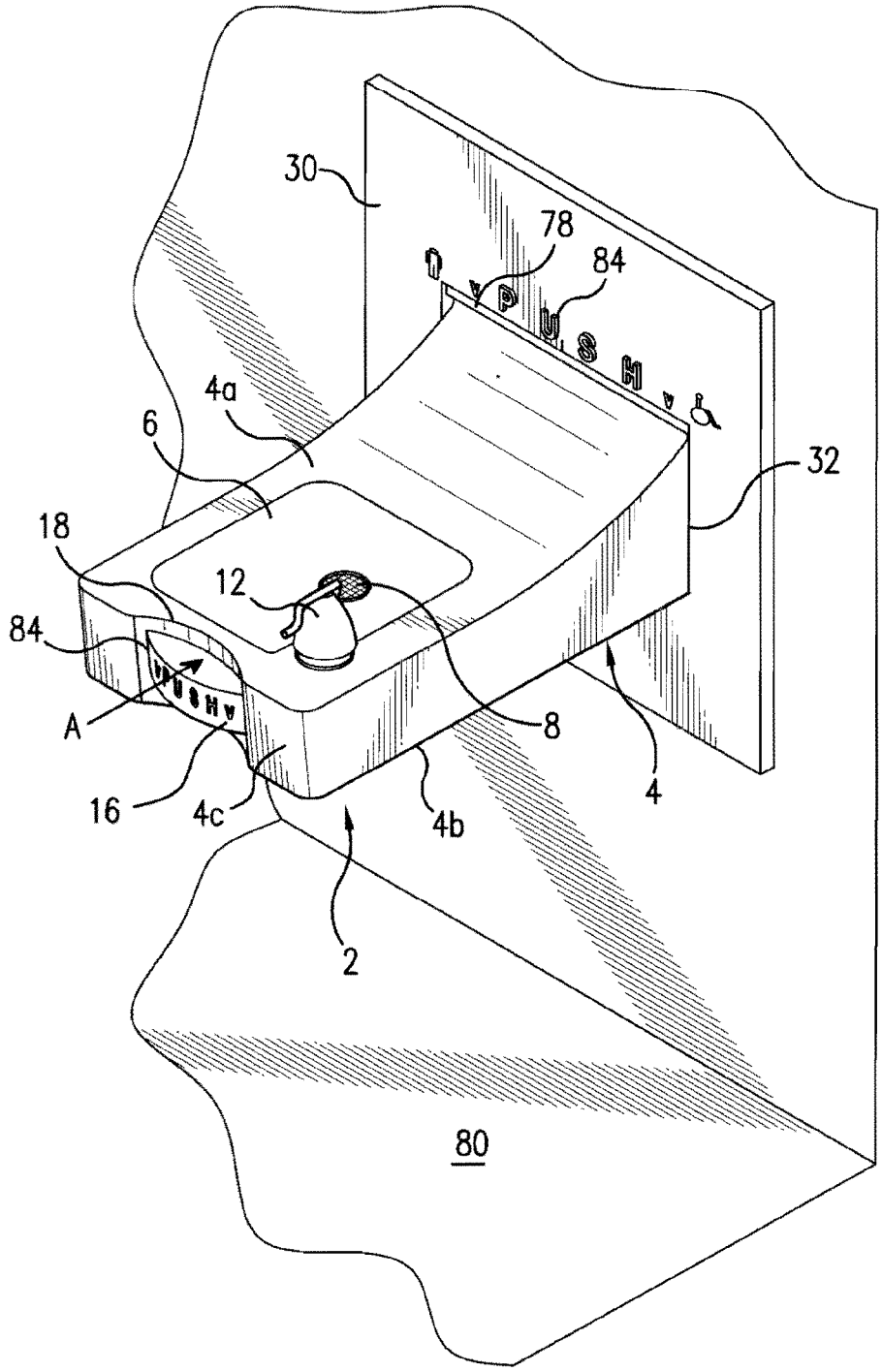
FIG. 1 is a perspective view of the water drinking fountain of the present invention.
Figure 2:
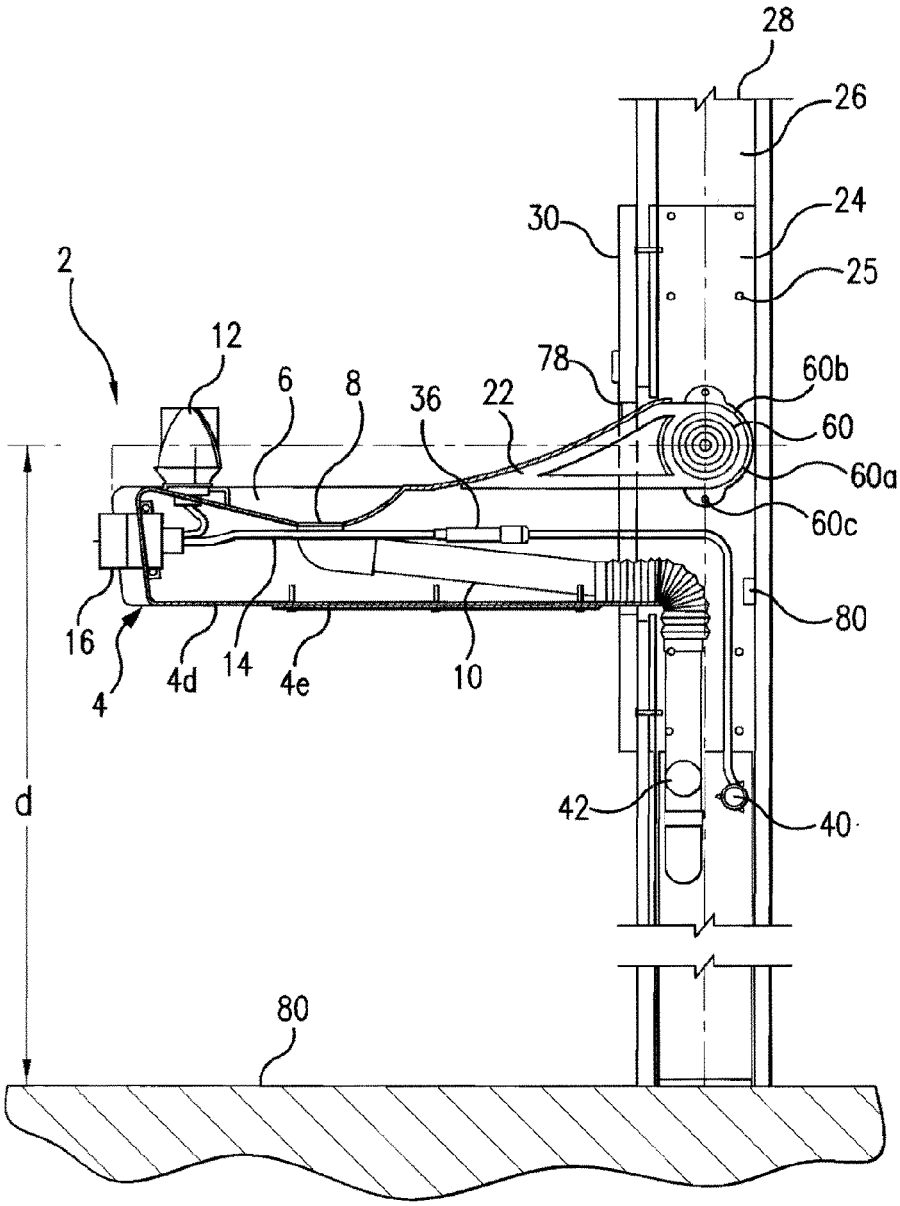
FIG. 2 is a vertical sectional view of the water drinking fountain of FIG. 1 when in its normal horizontal position.

Referring first more particularly to FIGS. 1 and 2, the water drinking fountain 2 of the present invention includes a generally horizontal fountain body 4 formed of stainless steel and having a top wall or deck 4*a*, a pair of vertical side walls 4*b*, a generally vertical front wall 4*c*, and a generally horizontal bottom wall 4*d* provided with a removable bottom access panel 4*e*. The top wall 4*a* contains a water basin 6 having a drain opening 8 that is connected with a drain pipe 10. Mounted on the top wall adjacent the basin 6 is a water faucet 12 that is supplied with water by a water supply conduit 14 via a manually-operable water control valve 16 mounted in a recess 18 contained in the fountain front wall 4*c*.

At its rear end, the fountain top wall surface is upwardly sloped for pivotal connection with fixed horizontal pivot means 20 including a pair of parallel spaced pivot arms 22 that are rotatably supported by a pair of stainless steel support plates 24 fastened by fasteners 25 between a pair of studs 26 that are part of fixed vertical wall support means 28. Fastened to the front surface of the support means 28 is a stainless steel front access plate 30 containing an opening 32 that receives the rear end of the fountain body 4.

In accordance with a characterizing feature of the invention, at least a portion of each of the water supply conduit 14 and the drain pipe 10 is flexible, thereby to permit the fountain body 4 to be pivoted upwardly (FIG. 3) or downwardly (FIG. 4) from the normal horizontal position shown in FIG. 2. In the illustrated embodiment, the water supply conduit 14, which includes a pressure regulator 36, is formed from a flexible synthetic plastic material, and the drain pipe 10 includes a pair of rigid synthetic plastic sections 10*a* and 10*b* that are joined by a flexible synthetic plastic section 10*c*. The water supply conduit 14 is connected with the water source 40, and the drain pipe section 10*b* is connected with the main sump 42.

Figure 2A:
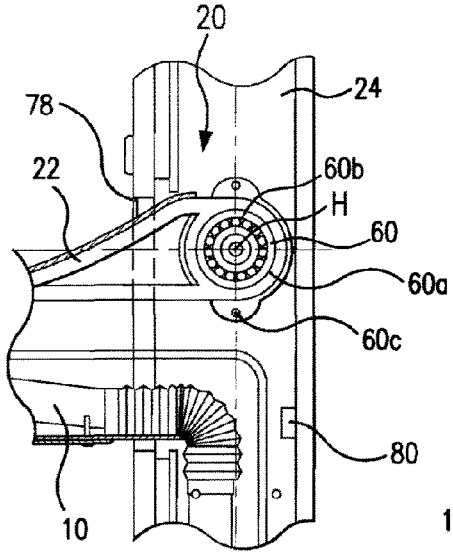
FIG. 2*a* is a detailed view of the pivot means of FIG. 2.
Figure 5:
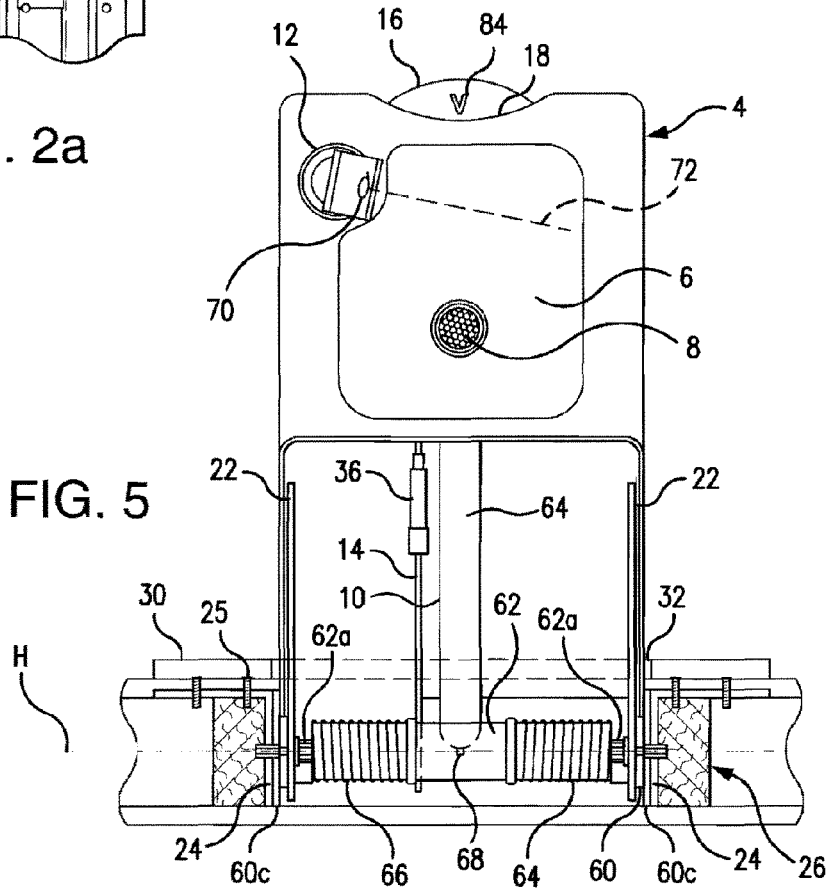
FIG. 5 is a horizontal sectional view of the apparatus of FIG. 2.

Referring now to FIGS. 2*a* and 5, the pivot means 20 supports the fountain body for pivotal movement about the horizontal pivot axis H. To this end, each of the pivot support arms 22 is mounted on the outer race 60*a* of ball bearing means 60 having a stationary inner race 60*b* provided with a flange portion 60*c* that is fastened to the associated support plate 24. A stationary air cylinder 62 has end portions 62*a* connected with the stationary inner ball bearing races. Mounted concentrically about the air cylinder are a pair of helical torsion springs 64, 66 the adjacent ends of which are connected with the stationary air cylinder, and the remote ends of which are connected with the pivot support arms 22, respectively. The torsion springs serve to bias the fountain body 4 toward the horizontal position of FIG. 2, at a rate controlled by the adjusting valve 68 of the air cylinder 62. The faucet 12 has a discharge spout 70 that discharges the water at a discharge pattern 72 that is slightly angularly arranged relative to the fountain front wall 4*c*.

Figure 3:
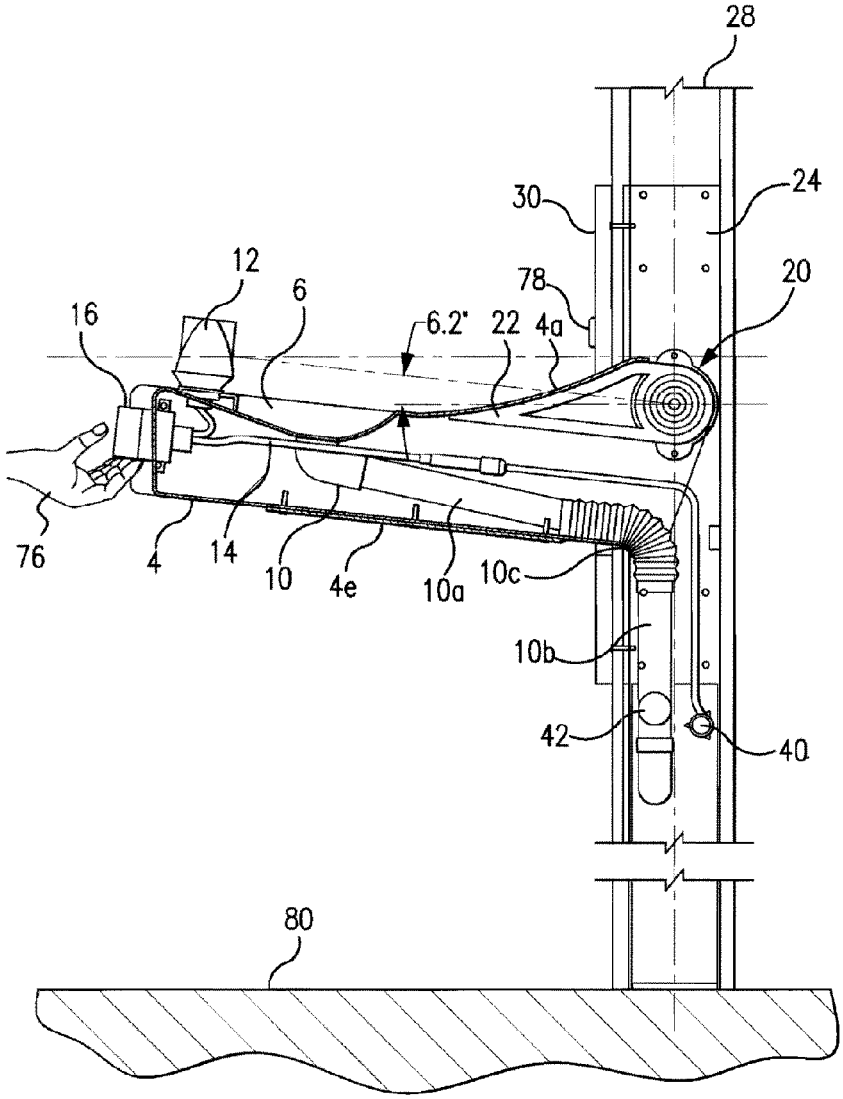
FIGS. 3 and 4 are vertical sectional views illustrating the drinking fountain in the elevated and lowered positions, respectively.
Figure 4:
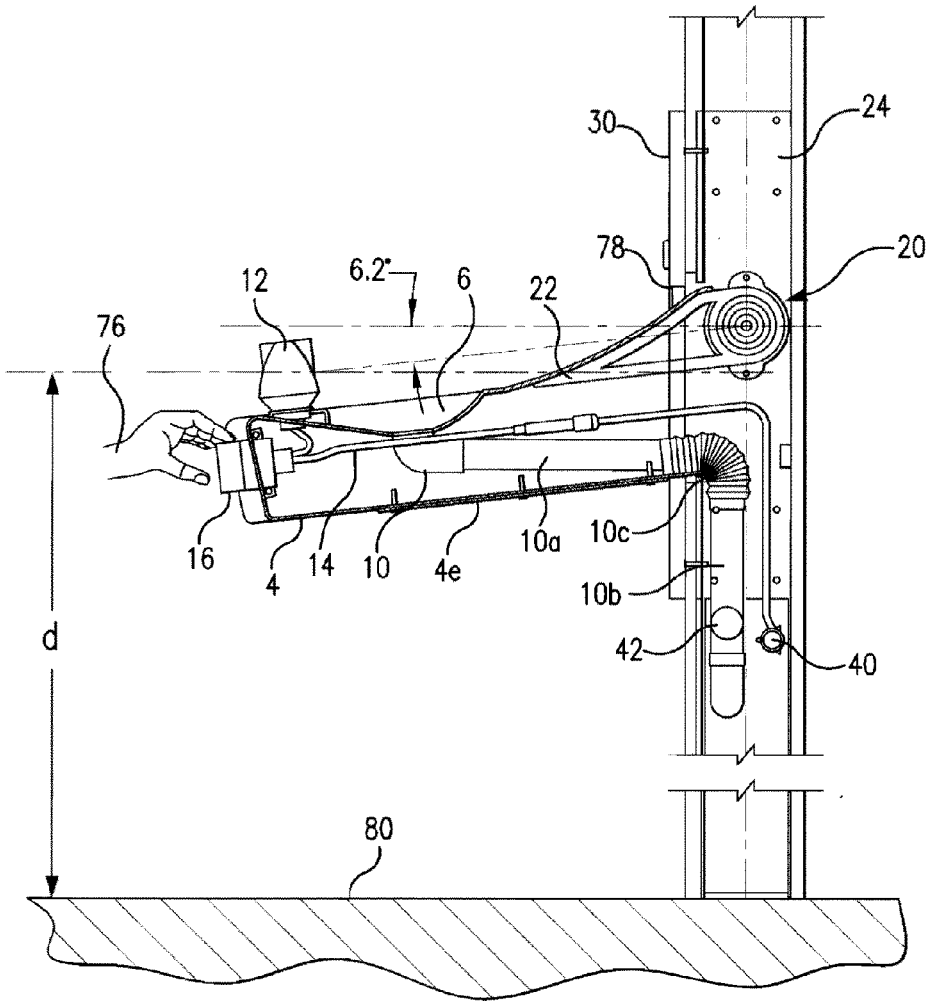

Referring again to FIG. 2, the pivot means 20 mounts the faucet 12 of the fountain body at a give height d relative to the horizontal floor surface 80, with the fountain body being biased toward this horizontal position by the torsions springs 64 and 66, as controlled by the air cylinder 62. Generally, this height is 37 inches for adults, with lower heights for different age groups. When the fountain body 4 is manually pivoted upwardly by contact of the user's hand 76 with the bottom surface of the control valve operator 16, the curved upper surface 4*a* engages a compressible sealing strip 78 that is mounted on the top and side edges of the opening 32 in front access plate 30. This limits the upward extent of travel of the fountain body, and also seals the access opening 32. When the fountain body is pivoted downwardly as shown in FIG. 4 by the manual application of force on the top surface of the water control valve operator 16, further downward travel is prevented by engagement of the rear edge portion of the fountain body with the stationary stop means 80 provided on the supports plates 24. No gasket is required at the bottom or underside juncture of fountain body 4 and the access plate 30 because this space is not exposed to normal view. As shown in FIGS. 3 and 4, the spout discharge pattern is displaced about 6.2 degrees from the horizontal plane passing through the pivot axis when the fountain body is in its raised and lowered positions.

The front access plate 30 and the valve operating member 16 are provided with raised indicia 84 providing the appropriate operating instructions. The rear of the fountain body upper surface 4*a* is ergonomically shaped to allow the front access plate 30 to remain in contact with fountain body during vertical adjustment. The curvature of the top deck is algorithmically designed to stay in contact with a neoprene or rubberized gasket 78 during fountain travel, up or down, visually concealing working components at the interior of apparatus. Furthermore, the rear of the fountain body has an upwardly directed shape that forces the predominance of any nuisance water emitted from the faucet 12 during operation that does not collect and discharge into the basin 6 rather than flowing into the rear of the apparatus. This transaction occurs in the vertically adjusted high position. The front edge of the deck is ergonomically shaped to allow a person's hand or appendage to reside on the water control valve operator 16. The fountain body is recessed to allow the surface area either above or below on the water control operator 16 to be accessed by a person's hand or appendage to apply pressure upwardly or downwardly on the water control operator 16. This vertical pressure displaces the drinking fountain up or down in a prescribed range of approximately 2 inches up or 2 inches down from a center residing point. The vertical adjustment allows for the water faucet 12 to range in height of approximately 35 inches to 39 inches above the floor or grade 80. This vertical adjustment most closely follows established and recommended reach and use ranges of a varying human populous.

The access plate 30 is embossed with tactile graphics 84 including the letters "PUSH" (English version) and universally acknowledged tactile symbols for directional arrows up and down and the universal symbol of a standing person next to the up arrow and a wheelchair symbol next to the down arrow. The water control member 16 will also have embossed tactile graphics 84.

In FIG. 2, the fountain body position is particularly shown at its center residing position of 35½ inches to the top of the fountain body above floor or grade 80 with notation of manual vertical adjustment of 33½ inches to 37½ inches. This range of manually adjusting vertical motion is particularly incorporated in the invention to correlate to prescribed accessible heights in the ADA and SAD for adult users. Younger age groups as classified in the ADA and SAD require modified and predominately lower reach and use ranges. The invention can likewise accommodate these user groups by varying the center residing position down at the time of installation of the invention. The aforementioned vertical motion will then meet prescribed accessible faucet heights for the user group served.

Fountain body 4 is preferably formed from stainless steel having a thickness consistent with current industry standards for drinking fountain deck bodies. All convex and concave edges are eased for user safety and aseptic control by manual cleaning. In particular, the front face 4*c* of the fountain body is sloped inward at the central residing position to produce a 90 degree vertical angle to floor or grade when manually adjusted to the high position shown in FIG. 3. The water control operator 16 however resides at a 90 degree vertical to floor or grade at the center residing position of the fountain. The front recess 18 allows top and bottom surface access to water control operator 16.

As shown in FIG. 2, a mechanically-attached stainless steel panel 4*e* is fastened by stainless steel screw type fasteners to the underside of the fountain body. This access bottom panel is removed to allow access to internal components such as water supply 14 and waste water drain 10. Water supply is commonly shown as a domestic water source provided by a ⅜" O.D. plastic piping connected to an industry standard pressure regulator 36 and water control operator 16. The flexible water line accommodates pivotal movement of the fountain body. The flexible water line is further connected to an industry standard water stop 40 of third-party origin. Water flow to faucet 12 via the regulator 36 producing movement up, down, or in/on water controller 16, producing a predictable flow of water to spout 70 through a flexible water line 14.

Water controller 16, consistent with current industry practice, contains a small manual adjustment valve to further control the rate of flow to spout 70. Water controller 16 is mechanically attached to reinforced portions of the fountain body in a sufficient manner to resist the aforementioned vertically applied manual pressure of the user, while allowing the toggle effect of water controller 16 to actuate the flow of water while fountain body movement is produced up or down by a manual pressure of about 5 lbs. The flow of water is produced by a manual pressure of a quantity less than 5 lbs to activate flow of water without producing movement of the fountain body. Water volume, trajectory, and angle of departure from spout 70 are all strictly controlled in accordance with mandates of the ADA and other socially accepted standards of use of drinking fountains. Water collection basin 6 in depth and shape is sufficient to collect waste water from operations and properly discharge waste water to waste water drain 8 in any residing position. The water collection basin is so shaped to allow positive drainage at extreme vertical movement normally produced in the low drainage position.

The steel metal support plates 24 fully anticipate varying types of vertical wall construction substrates including metal or wood studs 26, cementitious block materials (not shown), concrete (not shown), or the like. Various mechanical fasteners attach the wall carriage plate 30 to the vertical wall construction. Such attachment produces an industry standard vertical dynamic or static loading of a minimum of 300 lbs. downward or upward applied force. The steel metal support plates are also designed to be attached to an optional industry standard floor mounted steel chair carrier supports should vertical wall construction be insufficient to produce mandated vertical loading. The steel metal access plate is surface mounted to vertical wall construction.

The fountain body 4 is supported off of cantilevered arms 22 that make up a part of the ball bearing support means that allows deck movement up and down. The ball bearing means is likewise rigidly and statically attached to the support plate.

While in accordance with the provisions of the Patent Statutes the preferred forms and embodiments of the invention have been illustrated and described, it will be apparent to those skilled in the art that changes may be made without deviating from the invention described above.

What is claimed is:

1. An adjustable height water drinking fountain, comprising:

(a) a water drinking fountain body having a generally horizontal upper surface containing a water collecting basin, said drinking fountain body having front and rear ends, said drinking fountain body having a generally vertical front wall containing a recess, and a pair of generally vertical side walls;

(b) a vertical support;

(c) pivot means connecting said fountain body rear end with said vertical support to afford pivotal movement of said fountain body about an upwardly inclined raised position and a downwardly inclined lowered position relative to a horizontal plane passing through said horizontal pivot axis, respectively;

(d) biasing means biasing said fountain body toward said a normal horizontal position intermediate said upwardly inclined raised position and said downwardly inclined lowered position;

(e) a water faucet mounted on said water fountain body adjacent said water collecting basin;

(f) water supply means including a normally closed supply valve for supplying drinking water to said water faucet; and (g) drain means for removing waste water from said basin;

(h) said water supply means and said drain means each being at least partially flexible, thereby to permit pivoting of said fountain body between said normal horizontal position and said raised and lowered positions by a person in a standing condition and by a person seated in a wheel chair, respectively, said water supply means including a normally closed supply valve having a manual operating member extending into said front wall recess for engagement by the fingers of one hand of a user, thereby to effect displacement of said water drinking fountain body from said normal position toward one of said raised and lowered positions.

2. An adjustable height water drinking fountain as defined in claim 1, wherein said water supply means includes a conduit having:

(1) a vertical portion adjacent the vertical support; and (2) a horizontal portion arranged below said body upper surface and extending between said body rear end and said water supply valve;

(3) at least one of said vertical and horizontal conduit portions being flexible.

3. An adjustable height water drinking fountain as defined in claim 2, wherein said water supply means further includes:

(4) a pressure regulator connected in one of said vertical and horizontal portions.

4. An adjustable height water drinking fountain as defined in claim 2, wherein said water drain means comprises a drain pipe including:

(1) a vertical rigid pipe portion adjacent the vertical support;

(2) a horizontal rigid pipe portion arranged below said fountain body upper surface and extending between said body rear end and said basin; and (3) a flexible section connecting said vertical and horizontal pipe portions.

5. An adjustable height water drinking fountain as defined in claim 1, wherein said fountain body is angularly displaceable to displace said fountain body front end alternately about 2 inches upwardly or downwardly from said normal horizontal position.

6. An adjustable height water drinking fountain as defined in claim 5, wherein said fountain body is angularly displaceable between said raised and lowered positions by a force of about 5 pounds.

7. An adjustable height water drinking fountain as defined in claim 1, and further including:

(i) first stop means for limiting the extent of downward pivotal movement of said fountain body from said normal horizontal position; and (j) second stop means for limiting the extent of upward pivotal movement of said fountain body from said normal horizontal position.

8. An adjustable height water drinking fountain comprising:

(a) a water drinking fountain body having a generally horizontal upper surface containing a water collecting basin, said drinking fountain body having front and rear ends, said drinking fountain body having a generally vertical front wall, and a pair of generally vertical side walls;

(b) a vertical support;

(c) pivot means connecting said fountain body rear end with said vertical support to afford pivotal movement of said fountain body about a horizontal pivot axis between an upwardly inclined raised position and a downwardly inclined lowered position relative to a horizontal plane passing through said horizontal pivot axis, respectively;

(d) biasing means biasing said fountain body toward a normal horizontal position intermediate said upwardly inclined raised position and said downwardly inclined lowered position, respectively;

(e) a water faucet mounted on said water fountain body adjacent said water collecting basin;

(f) water supply means including a normally closed supply valve for supplying drinking water to said water faucet; and (g) drain means for removing waste water from said basin;

(h) said water supply means and said drain means each being at least partially flexible, thereby to permit pivoting of said fountain body between said normal horizontal position and said raised and lowered positions by a person in a standing condition and by a person seated in a wheel chair, respectively;

(i) first stop means for limiting the extent of downward pivotal movement of said fountain body from said normal horizontal position;

(j) second stop means for limiting the extent of upward pivotal movement of said fountain body from said normal horizontal position;

(k) a vertical planar access plate containing an opening that receives the rear end portion of said fountain body, said access plate being adapted for mounting on the vertical support; and (l) seal means for sealing the space between the upper and side surfaces of said fountain body and the edges of said access plate opening when said fountain body is in said raised position, said seal means at least partially defining said second stop means.

9. An adjustable height water drinking fountain as defined in claim 8, wherein the upper surface of the rear end of said fountain body is inclined upwardly in an arcuate concave configuration: and further wherein said seal means includes a horizontal portion that is engaged by said arcuate upper surface when said fountain body is in said raised position.

10. An adjustable height water drinking fountain as defined in claim 9, wherein said pivot axis is at a higher elevation than that of the front edge of the upper surface of said fountain body; and further wherein said pivot means includes a pair of parallel laterally-spaced pivot arms arranged between and connected with the inner surfaces of the side walls of said fountain body, respectively, said pivot arms being connected for pivotal displacement about said pivot axis.

11. An adjustable height water drinking fountain as defined in claim 8, wherein said water faucet includes a discharge spout having an angle of departure of about 12 degrees inclined rearwardly relative to a vertical plane containing the front edge of said fountain body upper surface.

12. An adjustable height water drinking fountain as defined in claim 8, wherein said water collecting basin is formed of stainless steel.

13. An adjustable height water drinking fountain as defined in claim 12, wherein said access plate is formed of stainless steel.

14. An adjustable height water drinking fountain as defined in claim 13, wherein said access plate carries operating instructions indicia.

* * * * *